US006998797B2

(12) United States Patent
Huang

(10) Patent No.: US 6,998,797 B2
(45) Date of Patent: Feb. 14, 2006

(54) DEVICE AND METHOD FOR ADJUSTING CURRENTS OF LAMP TUBES

(75) Inventor: Chien-Kun Huang, Taipei (TW)

(73) Assignee: BENQ Corporation, Taoyuan (TW)

( * ) Notice: Subject to any disclaimer, the term of this patent is extended or adjusted under 35 U.S.C. 154(b) by 90 days.

(21) Appl. No.: 10/814,424

(22) Filed: Mar. 30, 2004

(65) Prior Publication Data

US 2004/0207340 A1 Oct. 21, 2004

(30) Foreign Application Priority Data

Apr. 11, 2003 (TW) ..... 92108359 A

(51) Int. Cl.
*H05B 37/00* (2006.01)

(52) U.S. Cl. ..... 315/312; 315/224; 315/291; 315/307; 315/DIG. 7

(58) Field of Classification Search ..... 315/209 R, 315/291, 224, 247, 276, 307, 312, 324, 194, 315/297, DIG. 5, DIG. 7
See application file for complete search history.

(56) References Cited

U.S. PATENT DOCUMENTS 5,930,121 A * 7/1999 Henry ..... 363/16
6,127,785 A * 10/2000 Williams ..... 315/224
6,420,839 B1 * 7/2002 Chiang et al. ..... 315/311
6,534,934 B1 * 3/2003 Lin et al. ..... 315/312

* cited by examiner

*Primary Examiner*—Haissa Philogene
(74) *Attorney, Agent, or Firm*—Ladas & Parry LLP

(57) ABSTRACT

A device for adjusting currents of lamp tubes in a display. The device includes a feedback device, a first switch, a second switch, a main control device, a resonance circuit, a transformer, and a low-frequency switch controller. The low-frequency switch controller turns on the lamp tubes alternately. The feedback device monitors and adjusts the currents of the lamp tubes, thus the brightness of the lamp tubes are all the same.

8 Claims, 7 Drawing Sheets

DEVICE AND METHOD FOR ADJUSTING CURRENTS OF LAMP TUBES

BACKGROUND OF THE INVENTION

1. Field of the Invention

The present invention relates to a device and method for adjusting currents of lamp tubes.

2. Description of the Related Art

Display devices like CRT (Cathode Ray Tube) or LED (Light Emitting Diode) displays have so large a volume and power consumption that they cannot efficiently achieve user requirements. However, LCDs (liquid crystal displays) have advantages of not only smaller volume and lower power consumption, but also low radiation. LCDs have superior contrast and less indistinct moving pictures, thus LCDs better fit user requirements. Concurrently, the size of one LCD and the brightness of a backlight module for the LCD have been increased, but the CCFL (Cold Cathode Fluorescent Lamp) in the backlight module has a current saturation problem; that is, the brightness of the CCFL can not be increased only by increasing the current thereof. Thus, adding lamp tubes will be a better solution to achieve a higher brightness of the backlight module.

FIG. 1 shows a block diagram of a circuit in a backlight module with two lamp tubes. A feedback device 17 monitors currents I14*a* and I14*b* of a first lamp tube 14*a* and a second lamp tube 14*b* respectively, and then outputs a feedback signal S1 to a main control device 10. The main control device 10 outputs a driving voltage to a resonance circuit 11 according to the feedback signal S1, and then the resonance circuit 11 outputs a voltage-control signal. A transformer 12 increases the amplitude of the voltage-control signal to drive the first lamp tube 14*a* and the second lamp tube 14*b*. The first lamp tube 14*a* and the second lamp tube 14*b* shall have equal currents so as to produce equal brightness thereof. A first capacitance 13*a* and a second capacitance 13*b* are used to isolate DC voltage parts of the voltages of the first lamp tube 14*a* and the second lamp tube 14*b*. However, impedance characteristics of the first lamp tube 14*a* and the second tube lamp tube 14*b* are different from each other, and equivalent impedances of the first capacitance 13*a* and the second capacitance 13*b* have large errors. Thus, the currents 114*a* and 114*b* are not the same, and brightness of the first lamp tube 14*a* is not equal to that of the second lamp tube 14*b*. Therefore Resultantly, the brightness of the LCD is not uniform and lifetime of each lamp tube is decreased.

FIG. 2 shows a block diagram of a conventional circuit solving the problem of unequal currents. Feedback devices 27*a* and 27*b* monitor the current I24*a* of the first lamp tube 24*a* and the current I24*b* of the second lamp tube 24*b* respectively. Main control devices 20*a* and 20*b* receive feedback signals Sa1 and Sa2 and then adjust the currents I24*a* and I24*b* accordingly. The currents I24*a* and I24*b* are unequal because devices in each circuit for these lamp tube 24*a* and 24*b* have errors and different feedback points, and then brightness of the first lamp tube 24*a* is still not equal to that of the second lamp tube 24*b*. Thus the conventional circuit cannot entirely solve the problem of unequal currents, and, additionally requires a large number of additional devices in the circuits, increasing cost and possible errors of the circuits.

SUMMARY OF THE INVENTION

An object of the present invention is to provide a device for current control of lamp tubes in a display. The device solves the problem of unequal currents of a plurality of lamp tubes in an LCD, with reducing costs and decreasing errors.

In addition, another object of the present invention is to turn on a plurality of lamp tubes alternately by a low-frequency switch controller. Currents of these lamp tubes are all equal, and a feedback device monitors the currents so that the brightness of each lamp tube are the same.

To achieve the above-mentioned object, the present invention provides a device for adjusting currents of lamp tubes in a display. The display has a first lamp tube with a first current and a second lamp tube with a second current. The device for adjusting currents comprises a feedback device, a first switch, a second switch, a main control device, a resonance circuit, a transformer and a low-frequency switch controller.

The feedback device is used for monitoring the first and second currents of the first and second lamp tubes, and then outputs a feedback signal. The main control device outputs a driving voltage according to the feedback signal, and the resonance circuit outputs a voltage-control signal according to the driving voltage. Then, the transformer transmits a second voltage to the first and second lamp tubes according to the voltage-control signal, so that the first and second currents are generated. In addition, the low-frequency switch controller turns on the first switch and the second switch, alternately, at different times. The feedback device receives the first current as the first switch is turned on. The main control device adjusts the driving voltage according to the feedback signal so as to adjust the first current when the first current is not equal to a predetermined value.

Further, the feedback device receives the second current as the second switch is turned on, and the main control device adjusts the driving voltage according to the feedback signal so as to further adjust the second current when the second current is not equal to the predetermined value.

To achieve the above-mentioned object, the present invention provides a method for adjusting currents of lamp tubes in a display. The display has a first lamp tube with a first current, and a second lamp tube with a second current. The first lamp tube and second lamp tube are respectively turned on by a first switch and a second switch. First, applying a driving voltage to the first and second lamp tubes. Then, turning on the first switch and the second switch by a first pulse and a second pulse with an inverted phase to the first pulse so as to generate the first and second currents of the first and second lamp tubes. Finally, monitoring the first and second currents, and then adjusting the first current by adjusting the driving voltage when the first current is not equal to a predetermined value.

Further, the second current is adjusted by the driving voltage as the second current is not equal to the predetermined value.

BRIEF DESCRIPTION OF THE DRAWINGS

The present invention will become more fully understood from the detailed description given below and the accompanying drawings, given by way of illustration only and thus not intended to be limitative of the present invention.

DETAILED DESCRIPTION OF THE INVENTION

Figure 1:
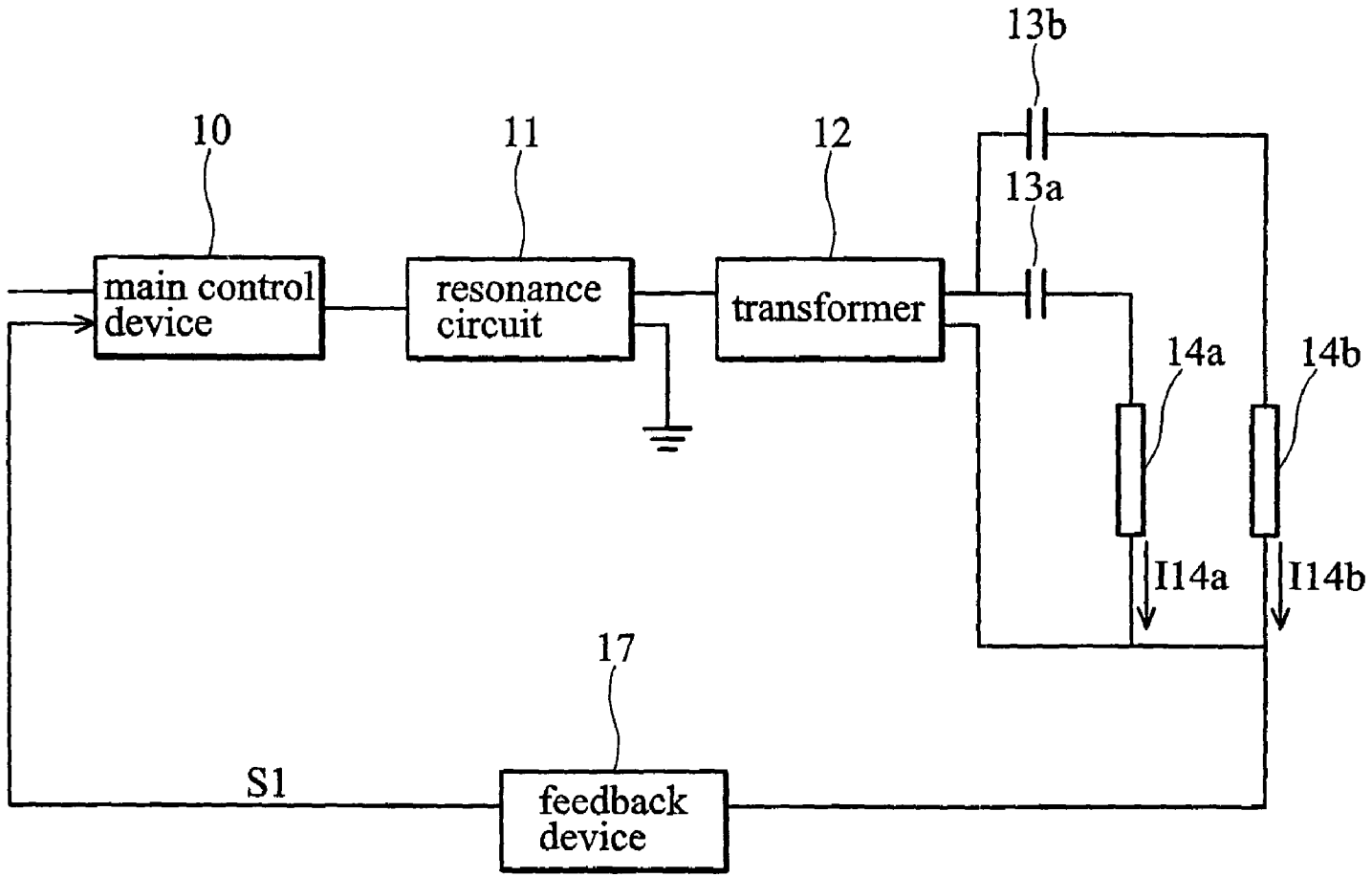
FIG. 1 (PRIOR ART)
FIG. 1 shows a block diagram of a circuit of a backlight module with two lamp tubes.
Figure 2:
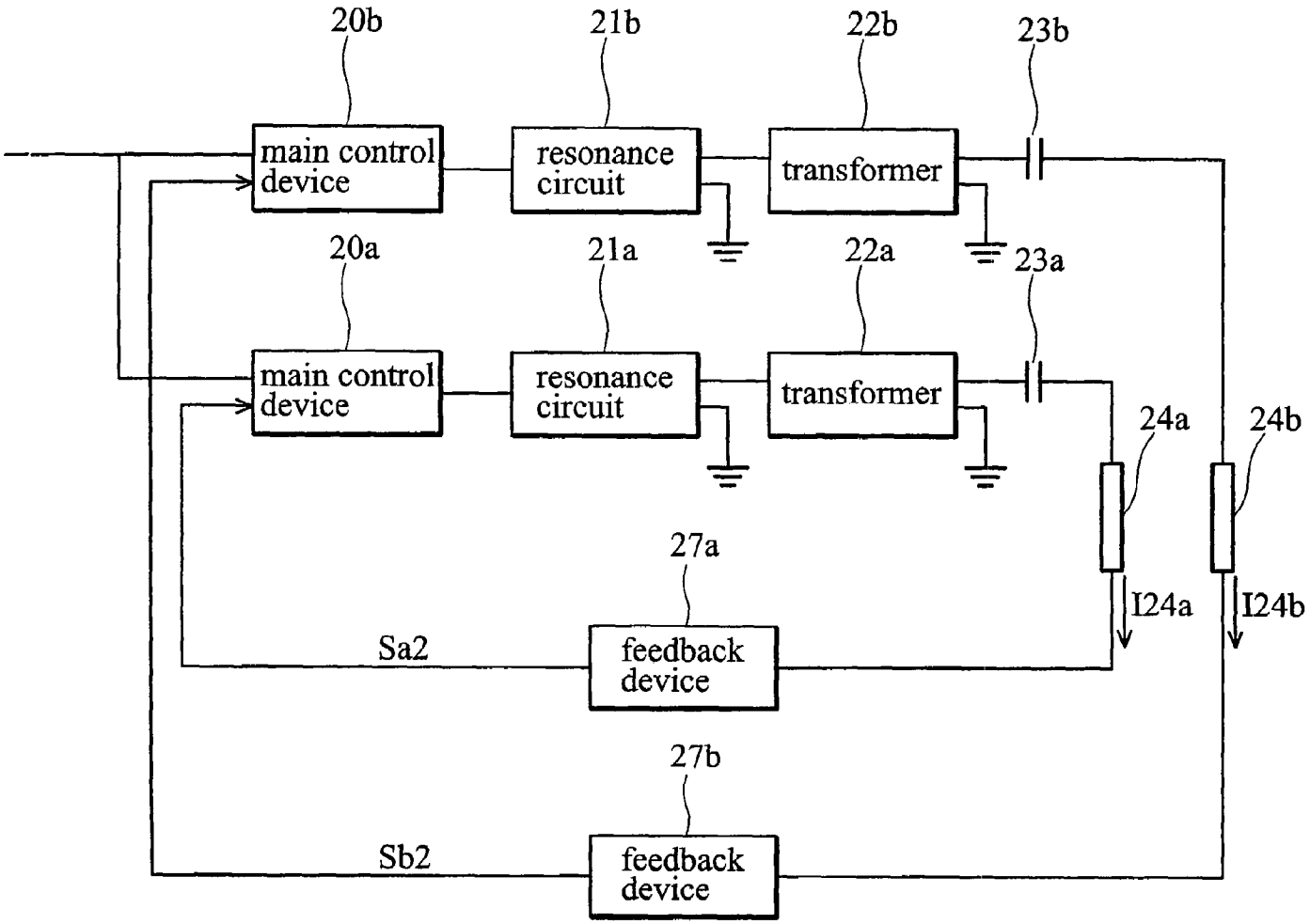
FIG. 2 (PRIOR ART)
FIG. 2 shows a block diagram of a circuit solving the problem of unequal currents in the prior art.
Figure 3:
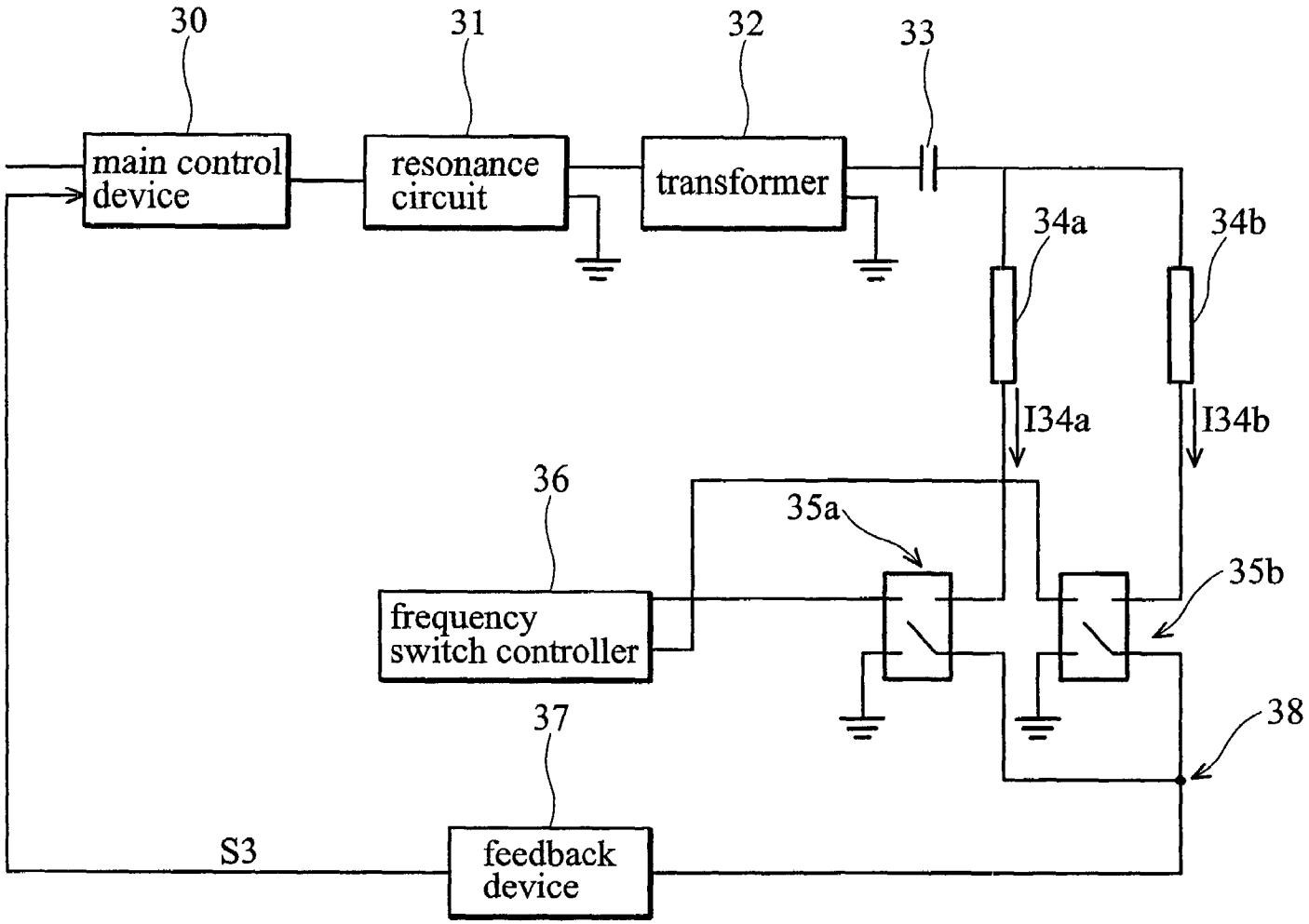
FIG. 3 shows a circuit of the embodiment of the present invention.

FIG. 3 shows a circuit of the embodiment of the present invention. Two lamp tubes are included in this embodiment.

In this embodiment, the device for adjusting currents of lamp tubes in a display includes a feedback device 37, a first switch 35*a*, a second switch 35*b*, a main control device 30, a resonance circuit 31, a transformer 32, and a low-frequency switch controller 36.

The main control device 30 outputs a driving voltage to the resonance circuit 31 according to a feedback signal S3. The resonance circuit 31 then outputs a voltage-control signal. The transformer 32 is positioned between the resonance circuit 31 and a common point of the first lamp tubes 34*a* and the second lamp tubes 34*b*; and the transformer 32 can increases the amplitude of the voltage-control signal. Thus, the transformer 32 outputs sufficient driving voltage to the lamp tubes 34*a* and 34*b*. Because the lamp tubes 34*a* and 34*b* are turned on by an alternating current voltage, a high voltage capacitor 33 is coupled between the transformer 32 and another common point of the lamp tubes 34*a* and 34*b* so as to isolate the DC voltage part of the driving voltage. The low-frequency switch controller 36 can turn on the first switch 35*a* and second switch 35*b* at different times. In addition, the low-frequency switch controller 36 generates a first pulse and a second pulse with an inverted phase to the first pulse so as to turn on the first switch 35*a* and the second switch 35*b*, respectively. Therefore, the lamp tubes 34*a* and 34*b* can be turned on at different times. When the first lamp tub 34*a* is turned by the first switch 35*a*, a first current I34*a* flows through the first lamp tube 34*a*. When the second lamp tub 34*b* is turned by the second switch 35*b*, a second current I34*b* flows through the lamp tube 34*b*. The feedback device 37 coupled to the connection point 38 of the lamp tubes 34*a* and 35*b* is used to monitor the first and second currents I34*a* and I34*b*. The feedback device 37 receives the first current I34*a* when the first switch 35*a* is turned on. If the first current I34*a* is not equal to a predetermined value, the feedback device 37 outputs the feedback signal S3, and the main control device 30 adjust the driving voltage so as to adjust the first current I34*a*. In addition, the feedback device 37 receives the second current I34*b* when the second switch 35*b* is turned on. If the second current I34*b* is not equal to a predetermined value, the feedback device 37 outputs the feedback signal S3, and the main control device 30 adjusts the driving voltage so as to adjust the second current I34*b*. Thus, the feedback device 37 monitors and equalizes the first and second currents I34*a* and I34*b*, so that the brightness of the first and second lamp tubes 34*a* and 34*b* can be equal to each other.

Figure 4:
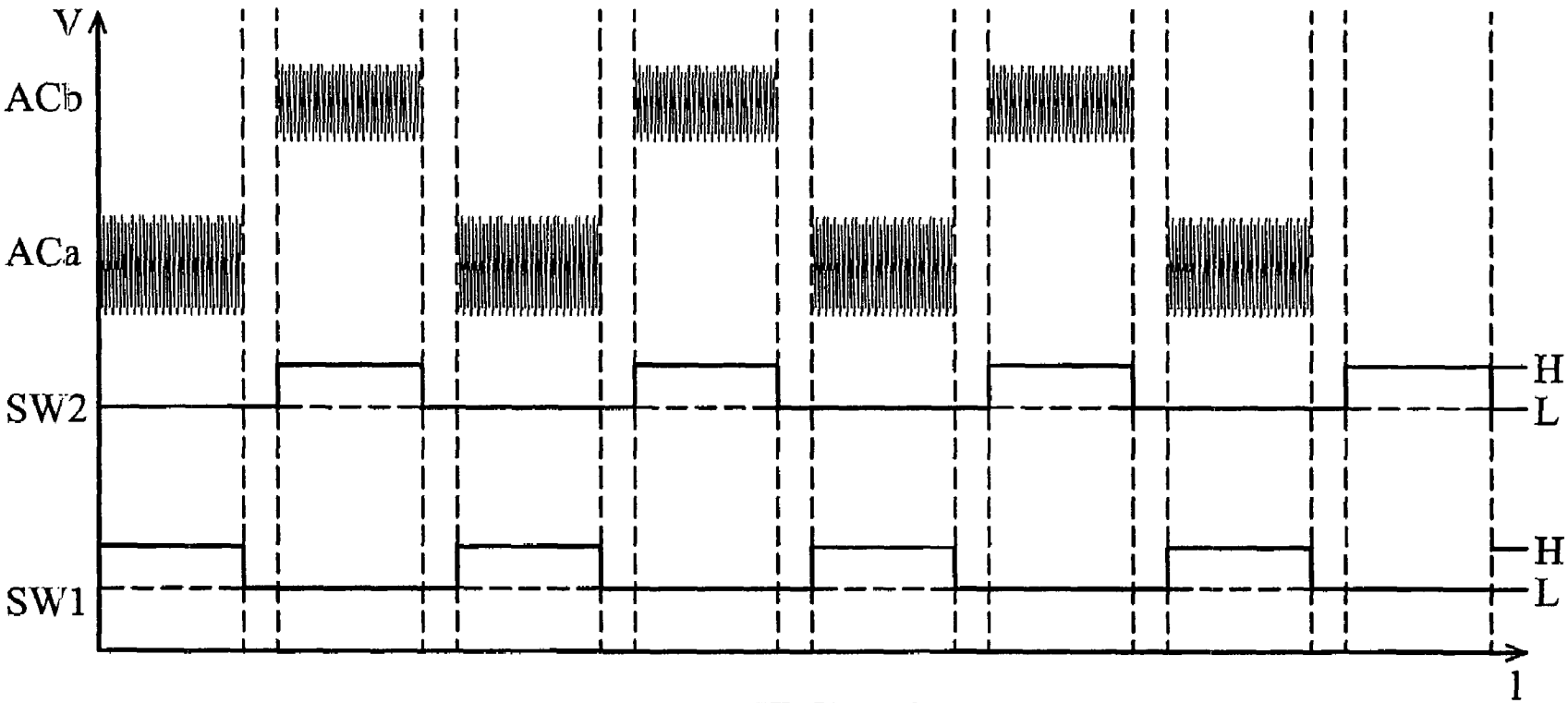
FIG. 4 is a timing chart of the lamp tubes.

FIG. 4 is a timing chart of to turn on the first and second lamp tubes, wherein labels SW1 and SW2 represent the first and second pulses, labels H and L represent a high level and a low level of the pulses, and labels ACa and ACb represent voltages applied to the first and second lamp tubes 34*a* and 34*b*, respectively. The preferred frequency is 200 Hz to 500 Hz. When the first pulse SW1 is in the high level (H), the first switch 35*a* is turned on, and the voltage (ACa) is applied to the first lamp tube in 34*a* to generate the first current I34*a*. When the first pulse SW1 is the low level (L), the first switch 35*a* is turned off. Similarly, when the second pulse SW2 is the high level (H), the second switch 35*b* is turned on, and the voltage (ACb) applies to the second lamp tube 34*b* to generate the second current I34*b*. When the second pulse SW2 is the low level (L), the second switch 35*b* is turned off.

Figure 5:
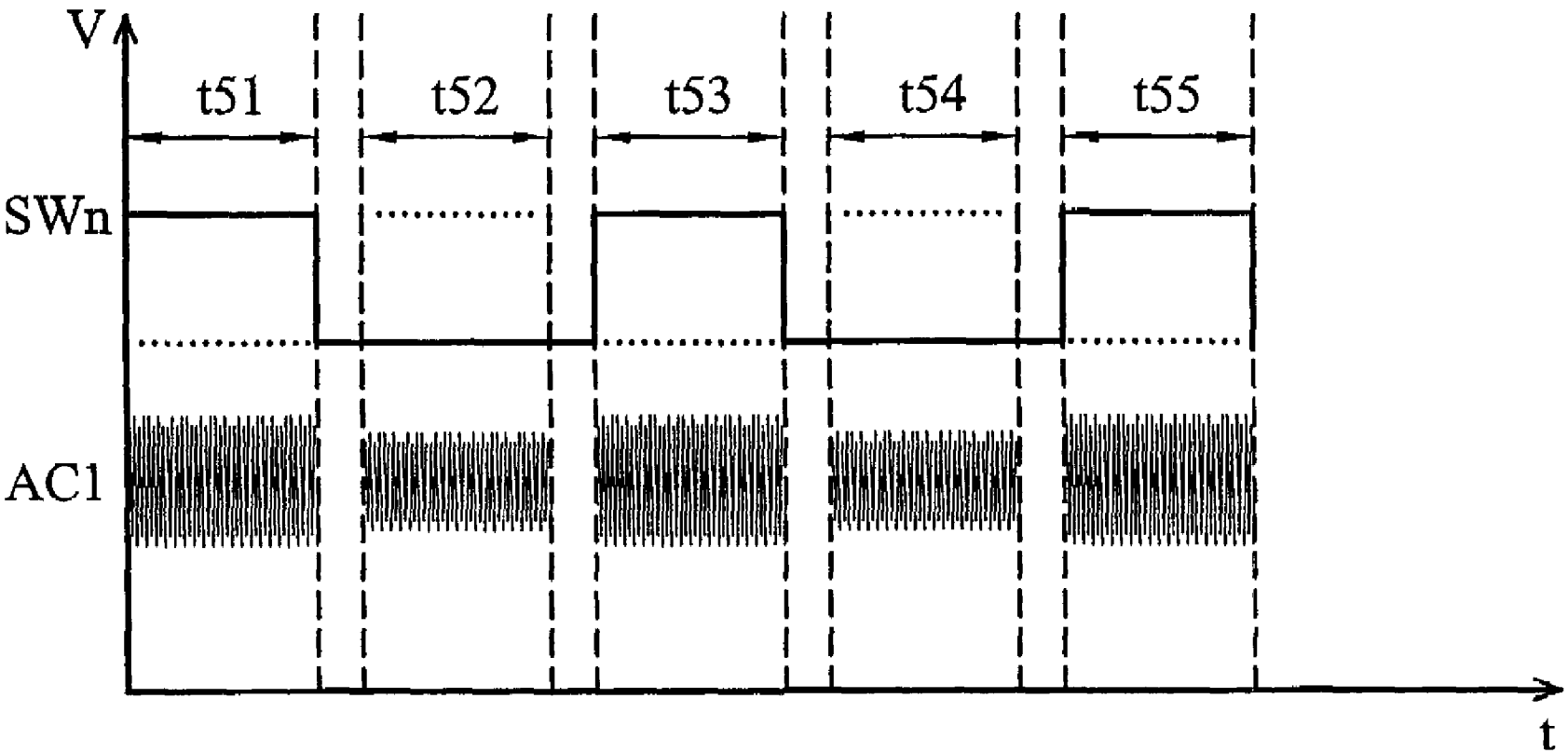
FIG. 5 is a timing chart of the brightness of one lamp tube in the present invention.

The turn-on times of the first and second lamp tubes are controlled by a working duty of the first pulse SW1 and the second pulse SW2. FIG. 5 is a timing chart of the first and second lamp tubes' brightness in the present invention. A label AC1 represents a combination of signals when the first and second lamp tubes are turned on. A label SWn represents a combination of the first and second pulses generated by the low-frequency switch controller 36, wherein one pulse is shown as a solid line, and another is shown as a dashed line. Time labels t51, t53 and t55 represent the time when the first lamp tube 34*a* is bright, and time labels t52 and t54 represent the time when the second lamp tube 34*b* is bright.

Figure 6:
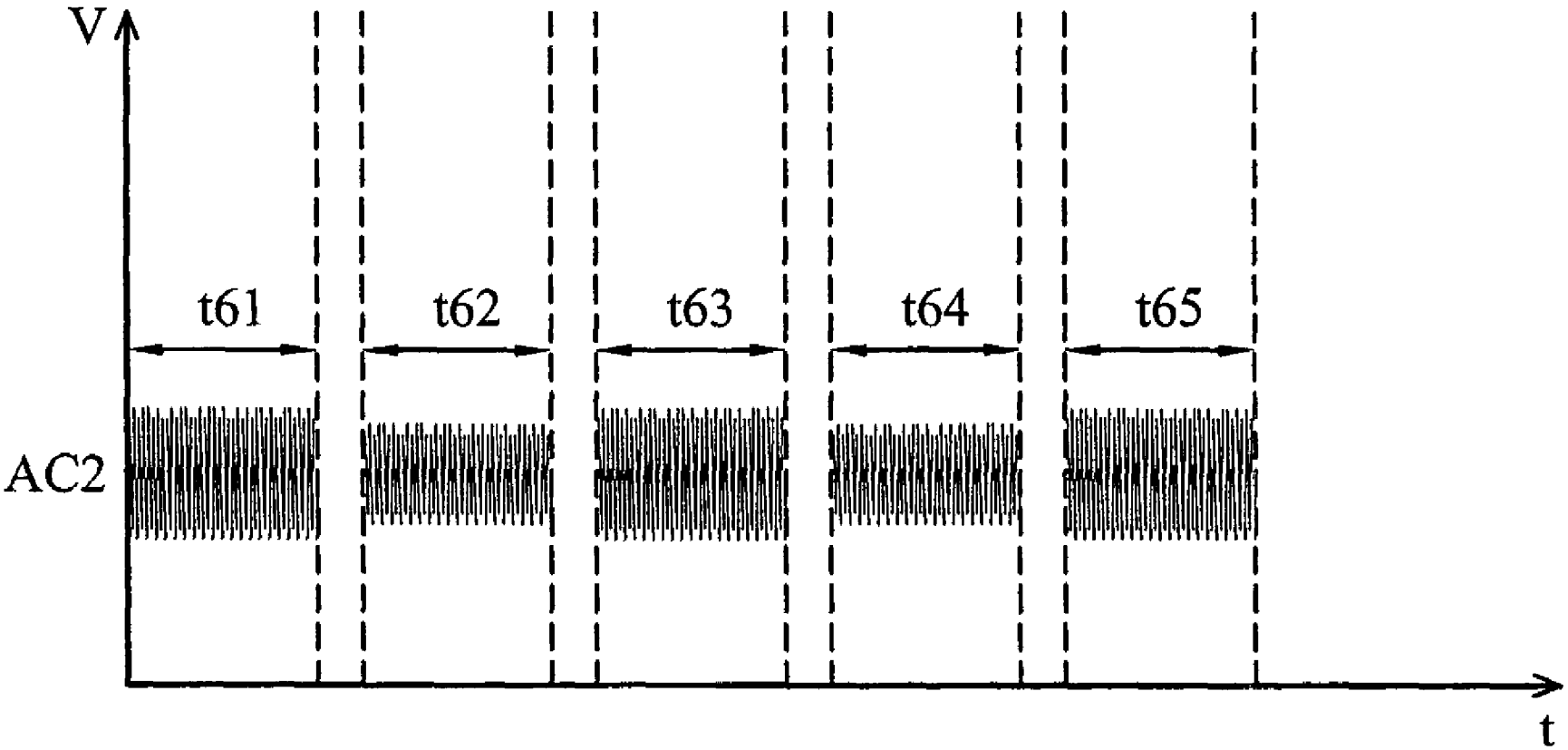
FIG. 6 is a timing chart of voltage variation of the transformer when the impedances of the two lamp tubes are different.

In the embodiment of the present invention, the feedback device 37 monitors the first and second currents I34*a* and I34*b* to adjust the driving voltage. As shown in FIG. 6, a label AC2 represents the driving voltage, labels t61, t63 and t65 represent the time when the lamp tube with a larger impedance is turned on, and labels t62 and t64 represent the time when the lamp tube with a smaller impedance is turned on. When the lamp tube with the larger impedance is turned on, the voltage amplitude of the driving voltage (AC2) is larger. Conversely, when the lamp tube with the smaller impedance is turned on, the voltage amplitude of the driving voltage (AC2) is smaller. As a result, the currents of the lamp tubes with different impedances can be adjust to be equal. That is, the first current of the first lamp tube can be equal to the second current of the second lamp tube. Therefore, the brightness of the first and second lamp tubes can be adjust to be equal.

Figure 7:
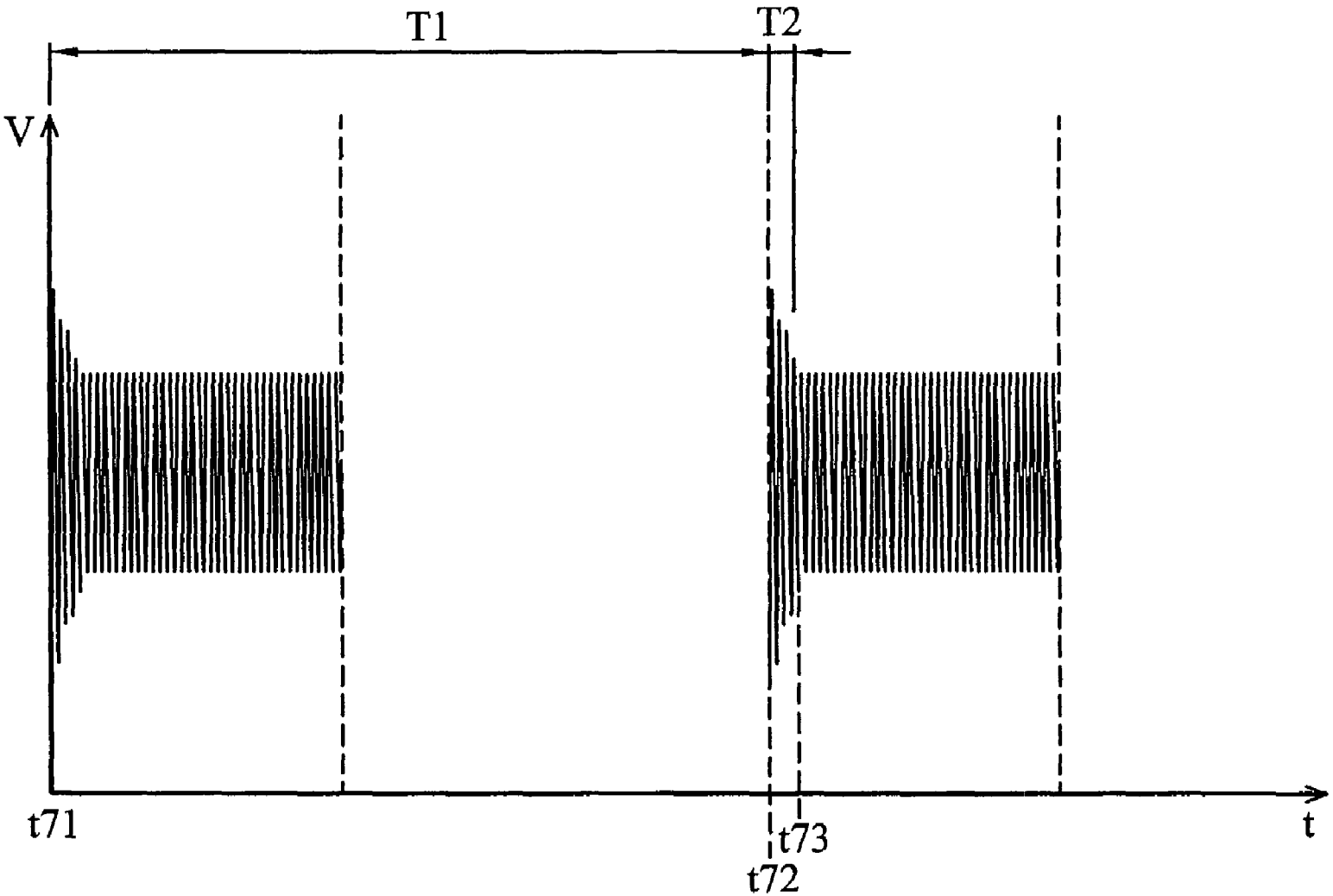
FIG. 7 is a timing chart of feedback stability of the present invention.

FIG. 7 is a timing chart of feedback stability of the present invention showing a voltage of the first lamp tube 34*a* being turned on and off. Also, this signal can be the voltage of the second lamp tube 34*b* being turned on and off. The low-frequency switch controller 36 generates the first pulse and the second pulse with an inverted phase to the first pulse, whose frequency is 200 Hz to 500 Hz (the period is 5000 ms to 2000 ms). As a result, period T1 (t71~t72) of turning on/off these lamp tubes 34*a* and 34*b* is 5000 ms to 2000 ms. In addition, period T2 (t72~t73) for the low-frequency switch controller 36 to exchange the different pulses with different phases and stabilizes the output pulse is only 10 ms, and the period T1 is long enough to stabilize the whole circuit.

As described, the present invention has several advantages over the prior art. First, the present invention is one simple circuit loop with fewer components, and thus, cost and error are decreased. Second, only one circuit is used to adjust the currents of at least two lamp tubes, these lamp tube have a same feedback point, such that the currents of these lamp tubes can be equalized, and the brightness of the lamp tubes can be equal to each other.

When the invention has been described by way of example and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A device for adjusting currents of lamp tubes in a display, the lamp tubes comprising a first lamp tube with a first current and a second lamp tube with a second current, the device comprising:

a feedback device for monitoring the first current and the second current, and outputting a feedback signal;

a first switch positioned between the first lamp tube and the feedback device;

a second switch positioned between the second lamp tube and the feedback device;

a main control device, coupled to the feedback device, for outputting a driving voltage according to the feedback signal;

a resonance circuit, coupled to the main control device, for outputting a controlling voltage signal according to the driving voltage;

a transformer, coupled to the resonance circuit, for providing a second voltage to the first and second lamp tubes signal to generate the first and second currents according to the controlling voltage; and a low-frequency switch controller for turning on the first switch and the second switch at different times;

wherein the feedback device receives the first current as the first switch is turned on, and the main control device adjusts the driving voltage according to the feedback signal so as to adjust the first current when the first current is not equal to a predetermined value.

2. The device as claimed in claim 1, wherein the feedback device receives the second current as the second switch is turned on, and the main control device adjusts the driving voltage according to the feedback signal so as to further adjust the second current when the second current is not equal to the predetermined value.

3. The device as claimed in claim 1, wherein the low-frequency switch controller generates a first pulse and a phase-inverted second pulse to drive the first switch and the second switch alternately.

4. The device as claimed in claim 1, further comprising a high voltage capacitor, coupled between the transformer and a common point of the first and second lamp tubes, for isolating a DC voltage part of the second voltage.

5. The device as claimed in claim 1, wherein the first pulse and the second pulse has a frequency of 200 Hz to 500 Hz, respectively.

6. The device as claimed in claim 1, wherein turn-on times of the first and second lamp tubes are controlled by a working duty of the first pulse and the second pulse.

7. A method for adjusting a first current of a first lamp tube and a second current of a second lamp tube in a display, the first lamp tube and a second lamp tube being respectively turned on by a first switch and a second switch, the method comprising steps of:

applying a driving voltage to the first and second lamp tubes;

turning on the first switch and the second switch by a first pulse and a second pulse with an inverted phase to the first pulse so as to generate the first and second currents of the first and second lamp tubes;

monitoring the first and second currents; and adjusting the first current by adjusting the driving voltage when the first current being not equal to a predetermined value.

8. The method as claimed in claim 7, wherein the second current is adjusted by the driving voltage as the second current is not equal to the predetermined value.

* * * * *